US006027620A

United States Patent [19]

Jackson et al.

[11] Patent Number: 6,027,620

[45] Date of Patent: Feb. 22, 2000

[54] FILTER PRESS ELECTROLYZER

[75] Inventors: John R. Jackson, Wilmington, N.C.; Mark Ullmann, Jacksonville, Fla.

[73] Assignee: Huron Tech Corp, Delco, N.C.

[21] Appl. No.: 09/088,566

[22] Filed: Jun. 1, 1998

Related U.S. Application Data

[63] Continuation-in-part of application No. 08/552,938, Nov. 3, 1995, abandoned.

[51] Int. Cl.[7] ..... C25B 9/00; C25B 11/00

[52] U.S. Cl. ..... 204/253; 204/254; 204/279; 204/290 F

[58] Field of Search ..... 204/279, 254–258, 204/296, 290 F, 253

[56] References Cited

U.S. PATENT DOCUMENTS

| | | | |
|---|---|---|---|
| 3,859,197 | 1/1975 | Bouy et al. | 204/256 X |
| 4,040,934 | 8/1977 | Hoekje et al. | 204/256 |
| 4,141,815 | 2/1979 | Ichisaka et al. | 204/290 F |
| 4,402,813 | 9/1983 | Kircher et al. | 204/279 |
| 4,439,298 | 3/1984 | Ford et al. | 204/258 |
| 4,568,439 | 2/1986 | Sobieniak | 204/253 X |
| 4,643,818 | 2/1987 | Seko et al. | 204/255 X |
| 4,695,359 | 9/1987 | Woodard, Jr. et al. | 204/279 X |
| 4,751,153 | 6/1988 | Roth | 204/253 X |
| 4,773,982 | 9/1988 | Divisek et al. | 204/279 X |
| 4,869,800 | 9/1989 | Hofmann et al. | 204/253 |
| 4,923,583 | 5/1980 | Woodard, Jr. et al. | 204/279 X |
| 5,082,543 | 1/1992 | Gnann et al. | 204/255 |
| 5,421,977 | 6/1995 | Getsy et al. | 204/263 |

*Primary Examiner*—Donald R. Valentine
*Attorney, Agent, or Firm*—Andrew E. Pierce

[57] ABSTRACT

A monopolar or bipolar filter press electrolyzer. The bipolar filter press electrolyzer can contain a bipolar electrode consisting of a planar metal anode and planar metal cathode electrically connected to respective planar current collectors which can be electrically connected by welding either directly or through an intermediate metal layer different than said metal anode or cathode, or by adhesive bonding utilizing an electrically conductive adhesive. The cell frames can be a molded thermoplastic polymer or laminated thermoplastic or thermosetting polymer sheets. The bipolar electrode assemblies can include at least a pair of thermoplastic or thermosetting cell frame units which can be assembled with either a single gasket or a polymer adhesive.

30 Claims, 2 Drawing Sheets

FILTER PRESS ELECTROLYZER

This is a continuation in part of application Ser. No. 08/552,938 filed on Nov. 3, 1995, now abandoned.

BACKGROUND OF THE INVENTION

1. Field of the Invention

This invention relates to a novel, multi-purpose electrolytic cell.

2. Description of Related Prior Art

Filter press bipolar electrolyzers are known. These have a bipolar wall or backplate separating the cathodic compartment from the anodic compartment of adjacent cell units in a series arrangement of the unit cells. On one side of the bipolar wall or backplate is the cathode structure and on the other side the anode structure. When multiple bipolar cell frames are connected in series to form the electrolyzer, an anode endplate and a cathode endplate is utilized at each end of the series to apply appropriate pressure to hold the units of the series together.

In electrochemical processes in which the anolyte and the catholyte and the respective electrolysis products must be kept separated, a permeable diaphragm or a semi-permeable membrane or a permselective membrane is positioned between the anode of a bipolar element and the cathode of an adjacent bipolar element. Electrical continuity between the anode of one unit in the series of bipolar elements and the cathode of an adjacent cell unit in the series is provided across the bipolar wall or backplate. The bipolar wall or backplate is, accordingly, cathodically polarized and in contact with the catholyte on one side and anodically polarized and in contact with the anolyte on the other side of the backplate. Consequently, the two surfaces of the bipolar wall or backplate may exhibit quite different corrosion resistance properties as a result of the use of different electrolyte and electrolysis products in contact therewith.

In prior art bipolar electrolyzers, the backplate is considered to have three functions. First, the backplate separates the catholyte of one bipolar cell from the anolyte of the adjacent bipolar cell of the electrolyzer. Second, the backplate serves as a conductive member connecting the cathode of one unit of the bipolar electrolytic cell with the anode of an adjacent cell of the bipolar electrolyzer. Third, the backplate acts as a structural member since both anodes and cathodes extend substantially perpendicular to the backplate.

Bipolar cells in which titanium or other valve metals are used as anodes in processes in which hydrogen is evolved from the cathode surface are subject to the disadvantage that during electrolysis nascent hydrogen, which is formed at the metal cathode surface, permeates through the metal cathode and attacks the titanium or other valve metal, on the anode side of the bipolar electrode. Titanium hydride is formed which can be the cause of blistering, embrittlement, flaking, misalignment, and stress cracking of the anode. Hydrogen continues to permeate through the titanium hydride thus formed which results in a further formation of titanium hydride and further deterioration of the anode. Deterioration of titanium anodes significantly decreases the useful life of bipolar electrodes, contaminates the products produced by bipolar cells, and increases the cost of operating the cell. Although other materials can be used in place of iron or steel for the cathode portion of the electrode, most metals that are useful are also permeable to hydrogen to some extent.

Filter press electrolyzers having cell units assembled utilizing a molded thermoplastic polymer filter press frame are known. Such filter press electrolyzers are known utilizing an injection molded plastic frame enclosing a chamber for electrolyte therebetween, as shown in U.S. Pat. No. 5,421,977 and references cited therein.

In U.S. Pat. No. 5,082,543 to Gnann et al, a filter press electrolysis cell is disclosed for the production of peroxy and perhalogenate compounds including peroxydisulfates and peroxydisulfuric acid. Platinum coated valve metal substrates are disclosed as anodes, the platinum layer being applied to the substrates by hot isostatic pressing or diffusion welding of a platinum foil onto the valve metal substrate. Preferably, the platinum foil has a thickness of about 20 to about 100 microns. The cathode used in the electrolytic cell is a perforated, liquid and gas permeable cathode of stainless steel which is further identified as tool steel number 1.4539. Electrolysis cell separators are disclosed as cation exchange membranes such as Nafion® 423. These are clamped between the frames of the cell and the frames are sealed by gaskets of a vinylidene fluoride-hexafluoropropylene copolymer.

In the filter press electrolysis cell described in U.S. Pat. No. 5,082,543 to Gnann et al., hollow cathodes and anodes are disclosed wherein the cathode hollow bodies are liquid and gas permeable and the anode hollow bodies have, above and below a platinum layer, openings for the introduction and removal of the anolyte. The effective anode surface is formed by the platinum layer of a composite anode comprising a valve metal substrate and a platinum layer present thereon which is obtainable by the hot isostatic pressing of a platinum foil onto a valve metal substrate. The cells of this reference are disclosed as useful for the production of peroxy compounds, specifically, the anodic production of peroxydisulfate, peroxomono sulfates, and peroxydiphosphates. By providing circulation of cooling water in the anode, the electrolysis operation is disclosed as being able to proceed with current densities of up to 15 $kA/m^2$ by reducing ohmic voltage losses caused by heating of the anode surface.

Gnann et al. in the '543 patent discloses an electrolysis cell having an anode hollow body and a cathode hollow body through which cooling water circulates in order to dissipate heat formed, particularly, in the anodic production of peroxydisulfates and salts thereof. Because such a cell design in which hollow electrodes are used is fraught with the danger of leakage of the cooling water into the cell electrolyte and, accordingly, requires effective, dependable sealing so as to avoid such leakage, with the possibility of precipitation of one or more electrolysis products within the cell, such a cell design has been intentionally avoided in favor of the use of external heat exchangers in the process of the invention.

SUMMARY OF THE INVENTION

In accordance with the invention, a monopolar or bipolar filter press electrolytic cell is disclosed. The electrolytic cell is, generally, useful for any electrochemical process. For instance, the cell is useful for the production of peroxydisulfuric acid or salts thereof utilizing a high overvoltage anode comprising a valve metal substrate having a discontinuous coating of a platinum group metal. In this process, a stainless steel cathode is preferred having substantially higher concentrations of nickel, chromium, and molybdenum in comparison with 316 stainless steel. The novel filter press electrolytic cell, preferably, has laminated sheets forming the plastic cell frames, generally, of a thermoplastic or thermosetting polymer, preferably, of polyvinyl chloride and, generally, laminated with a polymer adhesive, preferably, laminated with an elastomer modified vinyl ester polymer or an elastomer modified styrene copolymer adhesive.

The individual cell units of the filter press electrolyzer are assembled to form the filter press electrolyzer using a polymer adhesive or a single gasket between individual cell units. Where the electrolytic cell is utilized in a bipolar electrode configuration, the anode and cathode or the anode and cathode dual backplates, which are also known as current collectors, are electrically connected by welding or, preferably, by utilizing an electrically conductive polymer, preferably, a vinyl ester polymer containing a substantial proportion of graphite or metal particles to render the mixture electrically conductive. The filter press electrolysis cell can be operated utilizing as a cell separator either a permselective membrane or a porous, preferably, microporous diaphragm between the anode and cathode compartments of the cell.

BRIEF DESCRIPTION OF THE DRAWINGS

The electrolysis cell of the present invention and the advantages derived therefrom will become apparent upon consideration of the following specification in conjunction with reference to the accompanying drawings, in which.

DESCRIPTION OF THE PREFERRED EMBODIMENTS

Figure 1:
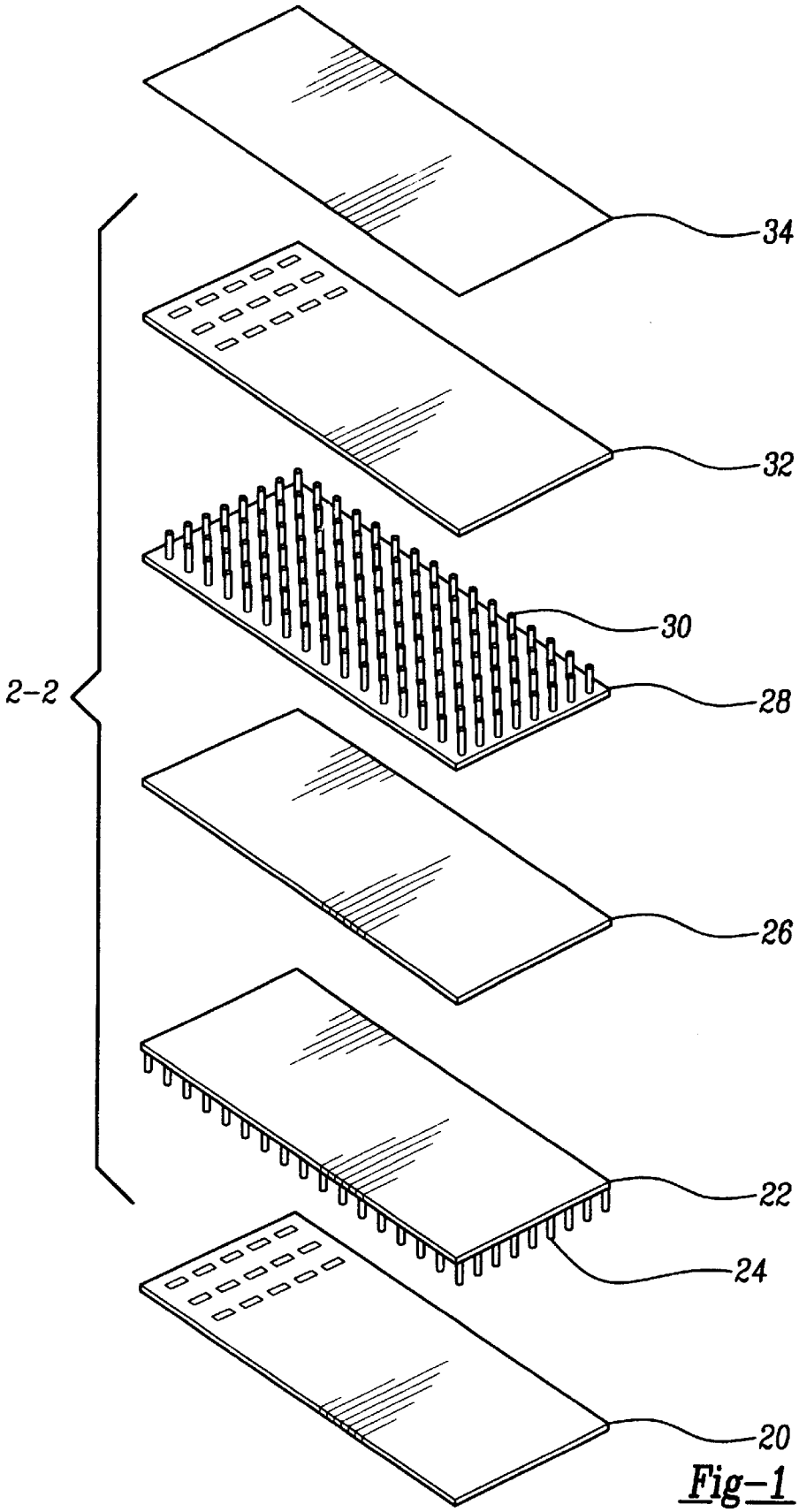
FIG. 1 is an exploded, perspective, diagrammatic view of a preferred cell unit of the bipolar electrolyzer of the invention which is simplified by eliminating cathode and anode bipolar cover frames, cathode and anode bipolar electrolyte flow frames, and gasket frames.
Figure 3:
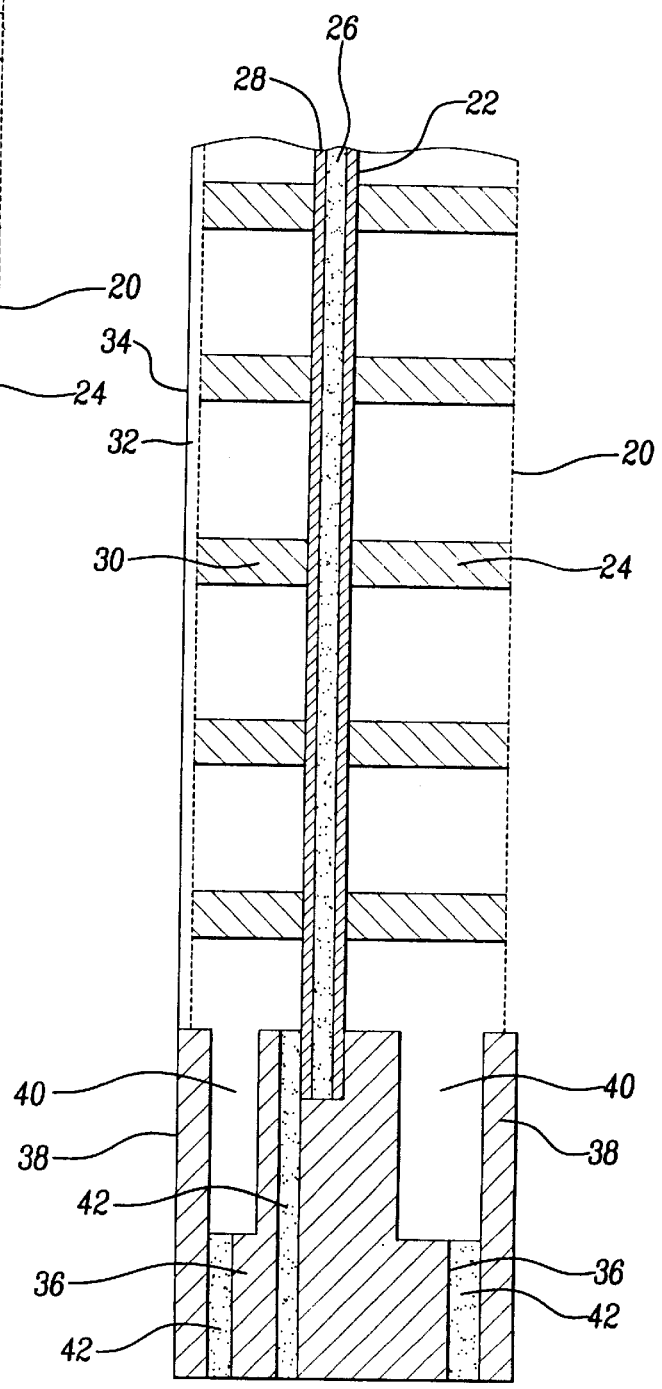
FIG. 3 is a partial, cross-sectional, diagrammatic view similar to FIG. 2 but with the addition of partial cell frames.

Referring to the drawings, a simplified and diagrammatic, perspective, partial view of one embodiment of a single unit of a multi-unit filter press electrolyzer is shown in an exploded view in FIG. 1. The cell unit comprises anode 20, anode spacer posts 24, anode backplate or current collector 22, adhesive layer 26, cathode backplate or current collector 28, cathode spacer posts 30, expanded metal cathode 32, and cell separator or membrane 34. It is to be understood that when the cell unit is assembled into a multi-unit filter press electrolyzer, each of the electrodes are separated from adjacent cell unit electrodes by membrane 34. The anode and cathode spacer posts permit adjustment of the gap between the anode or cathode of adjacent cell units and membrane 34. Not shown are frame portions which enclose the bipolar electrode and permit internal flow of the electrolyte. The anode and cathode frames which are formed of a laminate of polymer sheets, generally, laminated with a polymer adhesive allow secure assembly of each unit into multiple units by providing opposing cell frame unit surfaces which can be bonded as shown in FIG. 3, utilizing a polymer adhesive. Alternatively, a single gasket of uniform thickness between cell units can be used in conjunction with a cell frame sealing face having a depressed area to join multiple cell units to form the multi-unit bipolar electrolyzer of the invention.

Figure 2:
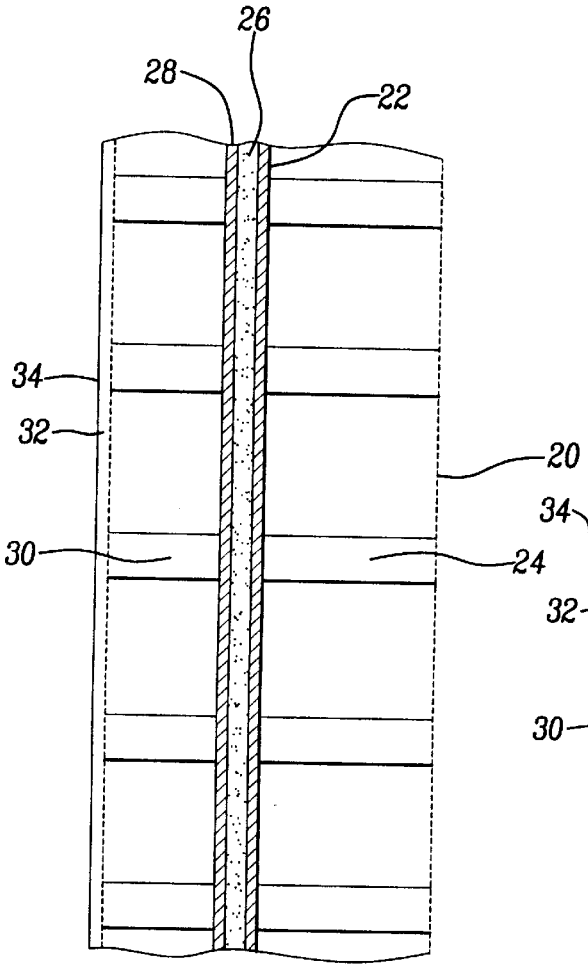
FIG. 2 is a partial, cross-sectional, diagrammatic view through section 2—2 of FIG. 1.

In FIG. 2, there is shown in cross-section through section 2—2 of FIG. 1 a simplified and diagrammatic partial view of a single unit of one embodiment of the bipolar electrolyzer of the invention in which anode 20 is shown in electrical contact with anode stand-off post 24 which is in turn in electrical contact with anode backplate or current collector 22. Cathode 32 is in electrical contact with cathode current collector or backplate 28 by way of cathode stand-off post 30. Electrical contact of the anode stand-off post 24 with anode 20 and anode backplate or current collector 22 or cathode stand-off post 30 with cathode 32 can be accomplished by any convenient means such as by spot welding. Adhesive layer 26 is used to bond anode current collector 22 to cathode current collector 28. Adhesive layer 26 is, preferably, formed of a vinyl ester polymer which is elastomer modified to provide greater flexibility and ductility of the vinyl ester polymer. Electrical conductivity can be provided in the adhesive layer by utilizing a sufficient amount of either or both graphite powder or metal particles as components of the vinyl ester polymer adhesive layer 26. The use of a polymer adhesive to bond anode current collector 22 and cathode current collector 28 avoids the possibility of hydride formation and subsequent failure during use of the preferred valve metal anode. The use of a conductive adhesive at the junction of the anode and cathode current collectors also permits the electrical connection of dissimilar non-weldable metal current collectors, the metals being chosen to withstand the corrosive effects of either anode or cathode electrolytes and electrolysis products.

In FIG. 3, there is shown in cross-section through section 2—2 of FIG. 1 the simplified and diagrammatic partial view shown in FIG. 2 with the addition of a partial view of the cell unit electrolyte external flow frames 38 and internal flow frames 36. Frames 36 and 38 define internal electrolyte flow channels 40. Adhesive 42 is, preferably, used to bond the mating surfaces of frames 36 and 38.

In the preferred bipolar electrolyzer of the invention shown in FIGS. 1, 2, and 3, the cells and components thereof are electrically connected at the bipolar electrode requiring only a cathode current distributor bus, not shown, for the first cell cathode assembly and an anode bus, not shown, for the final cell anode assembly. Current flows from each cathode through the compartments of the cells to the anode. The means for circulation of anolyte and catholyte is, preferably, internal. The components of the filter press electrolyzer of the invention can be standardized and readily adapted for making either a monopolar cell or a bipolar cell each having any number of identical cell units thus, offering economies of production.

The cathodes and anodes of the electrolyzers of the present invention can comprise various anodes and cathodes of the prior art such as foraminous anodes and cathodes which are generally known in the art. The active anode and cathode surface can be an uncoated substrate, for instance, for processes other than the persulfate process disclosed herein, prior art anodes such as nickel anodes can also be used. Alternatively, the active surface of the anodes can comprise a coated valve metal substrate having an electrocatalytic coating applied thereto. The electrocatalytic coating can be a precious metal and/or oxide thereof, a transition metal oxide, or mixtures of any of these materials. Any foraminous metal cathode can be used such as an expanded metal mesh, a perforated or non-perforated plate, or wire screening.

The bipolar electrode electrical connection can be formed by welding. For instance, the anode, cathode, and anode and cathode current collectors of the bipolar cell of the invention can be electrically attached, respectively, to anode and cathode spacer posts, for instance, by spot-welding. When a welding procedure is used to form the bipolar electrode and to attach the spacer posts to the electrodes and to the current collectors, such welding can also take the form of resistance welding, tungsten inert gas welding, electron beam welding, diffusion welding, and laser welding.

The gap between the electrodes and the cell membrane can be adjusted by extending or decreasing the dimension of the stand-off or spacer posts located between the electrodes and the current collectors. The cell membrane and electrode gap can also be easily maintained during cell operation by providing a series of non-conductive filaments over the face of the electrodes. Typically, the electrodes are wound with a polymer string such as a string of TEFLON®. Other useful and representative polymers for use are strings or filaments of polyvinyl chloride, acrylonitrile butadiene styrene polymer, styrene copolymer, and polypropylene.

One skilled in this art will understand that when the bipolar cell of the invention is used in any electrolytic process both the anode and cathode current collectors and the anodes and cathodes will be selected so as to be resistant to the electrolyte and the products of electrolysis with which they are contact. Similarly, the anode stand-off posts and the cathode stand-off posts will be selected to be of a material which is resistant to the electrolyte and electrolysis products with which they are in contact during operation of the cell. It is to be understood that although the spacer posts are shown in the drawings as rod shaped, that other shapes can be used such as oval, circular, or rectangular. In addition, reference to suitable metals for use as anodes, cathodes, stand-off posts and current collectors is meant to include the alloys and intermetallic mixtures of the metals referred to.

In the formation of the frames of each of the cell units of the monopolar or bipolar, preferably, bipolar electrode, each frame cell unit is, preferably, formed using laminated sheets of thermoplastic or thermosetting polymers. The cell frames can also be formed by molding thermoplastic polymers. The laminated sheets are bonded using any suitable polymer adhesive. Representative useful polymer adhesives include epoxy and phenolic polymers and silicone, polyurethane, and fluorine rubbers. Such frames must have the chemical resistance required to operate in contact with the electrolytes which will be utilized. For instance, the monopolar or bipolar electrode cell frame units can be selected to have suitable electrolyte corrosion resistance by using polymeric materials such as polyester, phenolic, or epoxy polymers, KYNAR®, CPVC, TEFLON®, styrene copolymers such as acrylonitrile butadiene styrene polymers (ABS), polypropylene, styrene copolymers and polyvinyl chloride (PVC).

Suitable cell separators can be porous, preferably, microporous membranes or diaphragms, and permselective membranes. Such cell separators for use between the anodes and cathodes of the preferred bipolar electrolyzer of the invention can be any of the several types which are commercially available. For instance, cell membranes can be formed of a perfluorinated copolymer having pendent cation exchange functional groups. Such perfluorocarbons are copolymers of at least two monomers in which one monomer is selected from a group consisting of vinyl fluoride, hexafluoropropylene, vinylidine fluoride, trifluoroethylene, chlorotrifluoroethylene, perfluoro (alkylvinyl ether), tetrafluoroethylene, and mixtures thereof. In the formation of such copolymers, a second monomer can be selected from a group of monomers containing $SO_2F$ or a sulfonyl fluoride pendent group. Such perfluorocarbons can be obtained commercially from the duPont company and are sold under the trademark NAFION®. The cell membrane can be a porous, microporous, or semi-permeable membrane such as those known in the art. Examples of porous membranes are those made of polyvinylidine fluoride (PVDF), polytetrafluoroethylene (PTFE), fiberglass, polyvinyl chloride (PVC), and styrene-acrylonitrile polymers.

The cell design of the invention can accommodate any prior art permselective membrane or porous diaphragm cell separator of any suitable prior art material having any suitable thickness. In forming a single gasket seal between the cell separator and cell units, the cell separator is assembled in one frame unit by placing the peripheral area of the separator in an annular depressed area or recess of the frame. This area is machined to a depth about 5 thousandths of an inch less than the thickness of the cell separator. The single gasket that separates the frame units in the filter press electrolyzer of the invention is then laid on top of the cell separator such that it overlaps the cover frame and covers the same peripheral area of the separator. When pressure is applied, i.e., when the cell is bolted together, the cell separator is tightly sealed between the cover frame and the gasket thus forming a leak free seal between the frames. Alternatively, the cell frame units are assembled by bonding with a polymer adhesive. Where molded or laminated thermoplastic polymer frames are used, the cell frame units can also be assembled by solvent bonding, for instance, styrene copolymer or polyvinyl chloride cell units can be bonded using ketone solvents such as acetone and methyl ethyl ketone to render the surface of the styrene copolymer or polyvinyl chloride frame material self-adhesive.

The advantages of this single gasket sealing method are as follows: (1) Machining the separator recess or depressed area in the cover frame to a depth slightly less than the thickness of the cell separator assures that there is adequate bolting pressure on the separator with minimal gasket compression. (2) Only one gasket is used, thus allowing the cell separator to remain exposed on one side to electrolyte, so as to remain flexible and resistant to tearing. The prior art cell designs use two gaskets, one on each side of the separator leaving the sealed area of the separator dry. (3) In addition to eliminating a second gasket, this approach eliminates a persistent source of separator failure in many filter press cell designs that use two gaskets. With the two gasket method of the prior art, the separator is kept liquid tight on both sides and therefore tends to dry out under the gaskets. This sometimes causes the separator to crack, and therefore fail, either under the gaskets or at the liquid edge of the gasket. This problem is particularly serious when O-ring seals are used against the membrane. (4) Use of a single gasket also allows a choice of gasket location, i.e., either on the anode or cathode side of the cell unit so that the gasket can be used to seal against the least corrosive of the two electrolytes. In some situations, one of the electrolytes is very corrosive and would require very expensive gaskets, such as Teflon gaskets, while the other electrolyte is relatively benign and would allow use of cheaper and more conventional gaskets such as those formed of elastomers, for example, Neoprene or ethylene propylene diene monomer polymers. This is the situation in the electrolytic manufacture of peroxydisulfuric acid and salts thereof where the anolyte is strongly oxidizing and very corrosive while the catholyte is only mildly corrosive.

For gasketing between the frames of cell units any suitable elastomeric material of any suitable uniform or variable thickness can be used, although rope gaskets such as those sold under the tradename Gore-Tex and O-rings can also be used. The preferred gasket materials are ethylene propylene diene monomer polymers, fluoroelastomers such as VITON®, and polychloroprenes such as Neoprene. Gaskets can be used as ribbons covering only the required seal areas or full face gaskets covering the whole frame face except for the window area and header holes. Full face gaskets are preferred because with ribbon gaskets it is hard to control the amount of gasket compression. Without good control over compression, it is difficult to control the gap between the anode and the membrane. In situations where narrow gaps are being used, too much gasket compression could close the gap up completely pushing the anode into the membrane. This is particularly likely with thicker gaskets. This problem in one embodiment of the cell of the invention is solved by using a gasket of variable thickness such that the thickened part exceeds the thickness of the thin part in an amount equal to the amount of desired compression used to seal the frame seal faces. The opposing frames are tightened until the frame faces meet against the thin part of the gasket.

The preferred full face gaskets are cut to cover the whole face of the frame surface except for the window area forming the electrolyte compartment and the header holes for electrolyte flow. In this way the total seal area is maximized. However, control over the amount of compression can be a problem in the prior art. Additionally, because full face gaskets cover such a large area, high bolting forces are sometimes needed in the prior art cells to compress the gasket enough to get a good seal. In the cell design of the invention, these problems can be overcome in another embodiment of the cell of the invention by machining away a depressed area of the frame material from the frame seal face such that the critical sealing areas are at least one or multiple raised ridges. It is preferred to machine away an amount of frame material equal to the desired compression of the gasket. For example, if the gasket is 0.125" thick and the desired compression is 30%, the amount of material machined away would be 0.125×0.3=0.038". This allows maximum pressure to be applied to the critical seal areas with minimum bolting forces. Cold flow at a thermoplastic cell frame seal face under the gasket is much less of a problem with the inventive cell design because the required compression to seal adjacent cell units results in no more than a slight rounding of the frame seal face ridge or ridges which would not affect the ability to make a seal and would not cause general distortion of the frame seal face. The preferred gasket thickness is ⅛". Thicker gaskets compress too much making it difficult to control the anode to membrane gap and they are also more expensive. Thinner gaskets are not likely to overcome the effects of imperfections in the frame seal face and also require more precise machining of the frame seal face.

While it is known that the sealing of the plastic frames of each cell unit to other cell units of a filter press electrolyzer can be accomplished by O-rings or flat gaskets between the individual cell units, it has been found advantageous to assemble molded or laminated thermoplastic or thermosetting polymer cell frame units utilizing an adhesive such as the preferred vinyl ester polymer described above in which the adherent toughness of conventional vinyl esters has been enhanced by reacting an elastomer onto the backbone of the vinyl ester. Improved bond strength can be obtained by mechanical or chemical abrasion or etching of the cell frame surfaces to be joined. Sandblasting or organic solvent etching have proven effective to prepare the plastic cell frame surface for bonding. It has been found that this vinyl ester resin is superior to the use of an epoxy resin adhesive. Alternative adhesive compositions to laminate the plastic sheets to form the cell frame units comprise the following compositions: epoxy, polyester, phenolic, silicone, polyurethane, and fluorine rubber polymers.

For use in the above process, the anode is, generally formed of a valve metal substrate such as titanium, tantalum, niobium, or zirconium, preferably, titanium, coated with a catalytic coating suitable for the desired electrolysis reactions. This catalytic coating is, preferably, a platinum group metal, preferably, a platinum foil which is applied so as to coat only a portion of the valve metal substrate to result in a discontinuously coated anode. The platinum group metal coating can be applied as various coating shapes, for instance, stripes, ordered dots, random dots or any other shapes. The percentage coverage may be from about 1 to about 99%, although about 20% coverage is preferred for the production of peroxydisulfuric acid and salts thereof. The individual parts of the preferred discontinuous catalytic anode coating are, most preferably, as small and numerous as possible such that the distance between them is minimized. The distance between coating shapes is up to twice the distance between the coated anode and the membrane separator, also known as the anode to membrane gap. The preferred platinum group metal, platinum, is, preferably, applied as stripes which are cold rolled onto the valve metal substrate so as to produce a durable anode material which is capable of operating at the high overvoltage conditions necessary to the production of peroxydisulfuric acid and salts thereof. The use of titanium as a preferred anode substrate in the presence of sulfuric acid, which has a reducing effect on the titanium, is made possible by the application of an anodic cell potential which makes the anode environment oxidizing. The discontinuously coated anode is also disclosed in the copending application of the applicants' assignee, Ser. No. 09/044,364, filed Mar. 19, 1998.

A novel electrode which can be used as an anode or cathode in the electrolytic cell of the invention is a mesh or expanded metal planar sheet of a stainless steel having higher concentrations of nickel, chromium, and molybdenum than the 316 stainless steel which has been used as a cathode in electrolytic cells for production of peroxydisulfuric acids and salts thereof. Specifically, the stainless steel electrode comprises in parts by weight about 20 to about 30 parts of nickel, about 15 to about 25 parts of chromium, and about 5 to about 7 parts of molybdenum. A typical composition in weight percent of stainless steels which are suitable as cathodes in the electrolytic cell of the invention is given in Table I in comparison with 316 stainless steel.

TABLE I

| | Stainless Steel components, weight percent. | | |
|---|---|---|---|
| Metal | Stainless Steel A | Stainless Steel B | ANSI 316 |
| Nickel | 24.0 | 25.0 | 12.0 |
| Chromium | 20.5 | 20.0 | 17.0 |
| Molybdenum | 6.3 | 6.5 | 2.5 |
| Silicon | 0.4 | 0.5 | 1.0 |
| Manganese | 0.4 | 1.0 | 2.0 |
| Iron | 48.0 | 47.0 | 67.0 |

The electrolytic cells of the invention can have electrodes arranged in either monopolar or bipolar configuration. Preferably, the electrolytic cells have a bipolar electrode configuration since, given the relatively high cost of the electrode materials, the use of thin planar sheets of electrode material allow the economical use of such high cost electrode materials. In addition, with a bipolar electrode configuration, the multiple electrical connections and multiple seals required at the monopolar electrode leads through a cell wall are avoided. In addition, since electrolytic cells for the production of peroxydisulfate and salts thereof require a relatively high current density at the anode of the cell, even a slightly higher electrode material resistivity can lead to severe heat generation at a monopolar connection. In contrast, with a bipolar electrode in such a cell such current distribution problems, which result from the resistivity of the electrode, are avoided. While the bipolar electrode configuration is less desirable from a current leakage point of view as compared with a monopolar electrode configuration, the use of small inter-cellular flow channels for electrolyte so as to reduce the current leakage and the use of larger electrolyte flow channels to aid in the distribution of electrolyte and for heat removal must be balanced.

In the preferred electrolytic cell bipolar electrode configuration having a valve metal anode substrate coated with a discontinuous coating of a platinum group metal, preferably platinum, the valve metal anode substrate is subject to exposure to hydrogen produced at the cathode of the cell. The hydrogen can migrate as atomic hydrogen through the bipolar cathode toward the valve metal anode substrate. Prior art bipolar cell configurations have suffered from the formation of a metal hydride at the single backplate or current collector junction of a valve metal anode and cathode of a bipolar electrode. While the hydride thus formed is a conductive material, the resistance of the hydride is greater than the resistance of the anode and cathode electrodes but, most importantly, because the hydride has a lower density than that of the pure metal from which the anode substrate and the cathode are formed, mechanical stresses can build up large enough to cause failure of the bipolar connection.

It is understood that the hydride formation at the electrical connection between the anode and cathode of the bipolar electrode is a consideration only when the anode and cathode are of dissimilar metals. Where the anode and cathode are of the same metal, the same piece of material is used for both the anode and cathode; the anode being welded on one side of the current collector and the cathode welded on the other side, both on stand-off posts made from the same materials as the anode and cathode. In such a bipolar electrode, hydrogen penetration to the current collector does not occur. When the anode and cathode current collectors are of dissimilar metals, electrical connection can be made by bonding current collectors with an electrically conductive polymer mixture or by direct welding techniques. Spot welding is the preferred welding technique. Not all anode materials are sensitive to hydride formation. However, if the anode metal is subject to hydride formation, as is the case with an anode comprising a valve metal, steps must be taken to avoid the rupture of the welded connection by hydride formation. As an alternative to direct welding to make the bipolar electrical connection or bonding the bipolar electrode utilizing a conductive polymer mixture, an intermediate metal layer between the anode and cathode or anode and cathode current collectors can be utilized which permits welding both anode and cathode or anode and cathode current collectors to the intermediate layer of metal. Examples of such metal materials are vanadium, copper, silver, and gold.

In addition to the formation of the bipolar electrode by the above means which avoid hydride formation and thus avoid the subsequent rupture of the bipolar electrode, it has been found that the use of stand-off posts separating the anode and cathode from, respectively, the anode and cathode current collectors greatly diminishes the likelihood of the migration of atomic hydrogen through the bipolar cathode toward the anode current collector. Stand-off posts separating the electrodes from the current collectors by at least about 3/16 of an inch have been found to be effective in diminishing the susceptibility of the anode substrate to hydride formation. Additionally, filling the spaces surrounding the stand-off posts which separate the cathode from the cathode current collector with a non-conductive material, such as a layer of polyvinyl chloride sheet material provides further resistance to hydride formation at the electrical connection of the bipolar electrode. Other useful non-conductive materials are polyesters, styrene copolymers, fluoropolymers, polychloroprene, and ethylene propylene diene monomer polymers. In order for atomic hydrogen to reach the anode, the hydrogen would have to travel through the non-conductive material layer located between the cathode stand-off posts to the cathode substrate or hydrogen would have to be evolved from the substrate around the base of the stand-off posts. In the first case, it would take a very long time for hydrogen to travel through such a thickness of metal. In the second case, hydrogen evolution by electrolysis will tend to take place preferentially on the areas of the cathode assembly closest to the anode. These areas are the cathode and not the cathode current collector since the current would have to travel through at least another 3/16 of an inch of electrolyte to reach the current collector.

Another means of reducing the likelihood of hydride formation has been found to be the use of precious metal electrocatalytic discontinuous coatings on only selected portions of the cathode assembly, thus lowering the electrode potential by up to 0.5 volts over the potential needed to evolve hydrogen from non-precious metal coated cathodes. Further improvements result where the electrode and current collectors are composed of distinct metals. In this case, the cathodes can be coated with a precious metal electrocatalytic coating and the current collectors left uncoated so that it is more favorable to evolve hydrogen from the cathode than from the current collector.

In the preferred embodiment of the filter press bipolar electrolytic cell of the invention, the possibility of hydride formation and the likelihood of failure of the junction of the anode and cathode, or the anode and cathode current collectors is avoided by the use of an electrically conductive adhesive to electrically connect anode and cathode or dual backplates or current collectors. The preferred conductive vinyl ester polymer adhesive used for bonding resists hydrogen migration so that failure of the bipolar electrode as the result of hydride formation is avoided. Alternatively, in another preferred embodiment, hydride formation can be prevented by the placement of an intermediate metal barrier layer not susceptible to hydrogen penetration between the bipolar anode and cathode or the anode and cathode current collectors. The barrier layer must be of a metal which is weldable to both anode and cathode electrodes or to both anode and cathode current collectors. Bipolar anode and cathode assemblies can be welded directly where both are either of the same metal or different metals which are weldable. Alternatively, in another preferred embodiment, hydride formation can be prevented by use of a sheet of non-conductive material between the cathode current collector or backplate and the cathode.

The preferred polymer material utilized to laminate sheets forming the laminated cell frames is an elastomer modified vinyl ester polymer which is superior to the polyesters utilized as adhesives in most conventional polyester applications. Other representative useful adhesive compositions can be prepared comprising the following polymer compositions: epoxy, polyester, phenolic, silicone, polyurethane, and fluorine rubber polymers.

The preferred vinyl ester polymer lamination adhesive for forming the cell frames or the polymer selected as a component of the conductive adhesive used to join the anode and the cathode of the bipolar electrode cell is made more flexible and ductile by reacting an elastomer onto the vinyl polymer backbone of the resin. This provides increased adhesive strength, superior resistance to abrasion and mechanical stress with double or triple the toughness performance properties of standard vinyl ester polymers. As with more conventional vinyl ester polymers the elastomer modified vinyl ester polymer can be reacted with peroxides such as methyl ethyl ketone peroxide and benzoyl peroxide to cure the resin so that it becomes resistant to an highly acid electrolyte. In order to provide the necessary conductivity, the vinyl ester polymer can be mixed with metal particles or graphite powder in the proportion of about 20 to about 60 percent by weight of the total composition. Preferably, about 30 to about 50 percent by weight of a graphite powder having a particle size of about 10 microns is mixed with about 70 to about 50 percent by weight of the vinyl ester polymer to form the electrically conductive adhesive composition preferably used to bond the anode and cathode current collectors of the bipolar electrode.

The anode and cathode are preferably, electrically connected to the respective current collectors by stand-off posts which are spot welded to the respective current collectors which are, in turn, preferably, bonded to make the bipolar electrical connection with an electrically conductive adhesive, as described above. The stand-off posts allow the adjustment of the anode and cathode gap between the cell separator by selection of stand-off post length. Generally, the respective anode and cathode current collectors can be omitted and the anode and cathode bonded directly.

While this invention has been described with reference to certain specific embodiments, it will be recognized by those skilled in this art that many variations are possible without departing from the scope and spirit of the invention, and it will be understood that it is intended to cover all changes and modifications of the invention disclosed herein for the purpose of illustration which do not constitute departures from the spirit and scope of the invention. Where not otherwise indicated, parts and percentages are by weight and temperature is in centigrade.

What is claimed is:

1. In a bipolar filter press electrolyzer comprising a planar catalytically coated or uncoated valve metal anode, a planar valve metal anode current collector, a planar cathode and a planar cathode current collector wherein said cathode and said cathode current collectors are separated by electrically conductive stand-off posts, the improvement wherein a non-conductive material layer is placed in an area surrounding said stand-off posts between said cathode and said cathode current collector.

2. The bipolar filter press electrolyzer of claim 1 wherein said non-conductive layer is selected from polymers of the group consisting of polyesters, styrene copolymers, fluoropolymers, polychloroprene, and ethylene propylene diene monomer polymers.

3. The bipolar electrolyzer of claim 2 wherein said catalytically coated anode comprises a discontinuous coating of a platinum group metal on a valve metal substrate and said cathode comprises a stainless steel comprising about 20 to about 30 weight percent nickel, about 15 to about 25 weight percent chromium, and about 5 to about 7 weight percent molybdenum.

4. The bipolar filter press electrolyzer of claim 3 wherein said valve metal substrate is selected from the group consisting of titanium, niobium, and zirconium and said platinum group metal is platinum.

5. In a bipolar filter press electrolyzer comprising a bipolar electrode comprising a cathode and a cathode current collector, an anode and an anode current collector, a cell separator, and cell frames, the improvement wherein said frames consist of a laminate of thermoplastic or thermosetting polymer sheets with an adhesive between adjacent sheets or thermoplastic polymer sheets self-adhered by rendering at least one surface of adjacent sheets self-adhesive utilizing a solvent for said thermoplastic polymer.

6. The filter press electrolyzer of claim 5 wherein said laminate consists of multiple layers of said polymer sheets and a polymer adhesive selected from the group consisting of a vinyl ester polymer, an epoxy polymer, a phenolic polymer, a silicone polymer, a polyurethane polymer, and a fluorine rubber polymer.

7. The filter press electrolyzer of claim 6 wherein said laminate consists of thermosetting polymer sheets selected from polymers of the group consisting of vinyl esters, epoxy, and phenolic polymers.

8. The filter press electrolyzer of claim 6 wherein said laminate consists of polymer sheets selected from polymers of the group consisting of acrylonitrile butadiene styrene polymers, polypropylene, styrene copolymers, and polyvinyl chloride.

9. The filter press electrolyzer of claim 8 wherein said cell frames are laminated with a vinyl ester polymer adhesive.

10. The filter press electrolyzer of claim 6 wherein said laminate consists of styrene copolymer or polyvinyl chloride sheets and a vinyl ester polymer adhesive therebetween.

11. A filter press electrolyzer comprising multiple cell units, each cell unit comprising a cell frame consisting of laminated polymer sheets defining an electrolyte compartment with an adjacent cell frame, wherein adjacent cell units are sealed against electrolyte leakage utilizing a single gasket wherein a sealing surface of at least one cell unit of a pair of adjacent cell units comprises at least one depressed area.

12. The filter press electrolyzer of claim 11 wherein said single gasket is a ribbon or full face gasket having variable thickness and wherein a sealing surface of at least one cell unit of a pair of said cell units comprises at least one depressed area sufficient to receive a portion of said single gasket.

13. The filter press electrolyzer of claim 11 wherein said single gasket is a ribbon or full face gasket having uniform thickness and wherein a sealing surface of at least one cell unit of a pair of said cell units comprises at least one depressed area sufficient to receive a portion of said single gasket.

14. The filter press electrolyzer of claim 13 wherein said gasket is an elastomeric material selected from the group consisting of ethylene propylene diene monomer polymers and copolymers of vinylidine fluoride and hexafluoropropylene.

15. The filter press electrolyzer of claim 11, each cell unit comprising a cell frame consisting of a laminated thermoplastic polymer sheet or a laminated thermosetting polymer sheet, said anolyte and catholyte compartments are separated by a cell separator, and a peripheral portion of said cell separator is positioned in an annular depressed area of a sealing surface of said cell frame.

16. The filter press electrolyzer of claim 15 wherein the depth of said annular depressed area is about 5 thousandths of an inch less than the thickness of said cell separator.

17. In a filter press electrolyzer comprising multiple cell units each cell unit comprising a thermoplastic polymer cell frame consisting of laminated polymer sheets defining with an adjacent cell frame an anolyte or catholyte compartment, the improvement wherein adjacent cell units are bonded with a polymer adhesive or bonded by the application of a solvent for said thermoplastic polymer to a sealing area surface prior to bonding.

18. The filter press electrolyzer of claim 17 wherein said polymer adhesive is selected from the group consisting of a vinyl ester polymer, an epoxy polymer, a phenolic polymer, a silicone polymer, a polyurethane polymer, and a fluorine rubber polymer.

19. The filter press electrolyzer of claim 18 wherein said polymer adhesive comprises a vinyl ester polymer.

20. The filter press electrolyzer of claim 18 wherein said frames of said cell units are rendered self-adhesive by partial solution in a solvent for said cell frames.

21. In a bipolar filter press electrolyzer comprising a bipolar electrode comprising a planar cathode and a planar cathode current collector, a planar anode and a planar anode current collector, a cell separator, and cell frames, wherein the bipolar electrode is electrically connected between said anode and cathode or said anode and cathode current collectors by means comprising bonding with an electrically conductive polymer mixture, welding, or welding through an intermediate layer of a different metal than said anode and said cathode, the improvement wherein said frames consist of a laminate of thermoplastic or thermosetting polymer sheets with an adhesive between adjacent sheets or thermoplastic polymer sheets self-adhered by rendering at least one surface of adjacent sheets self-adhesive utilizing a solvent for said thermoplastic polymer.

22. The bipolar electrolyzer of claim 21 wherein said electrically conductive polymer mixture comprises a polymer adhesive selected from the group consisting of a vinyl ester, an epoxy, a phenolic, a silicone, a polyurethane, and a fluorine rubber polymer.

23. The bipolar electrolyzer of claim 22 wherein said electrically conductive polymer mixture comprises a vinyl ester polymer or styrene copolymer and a filler material comprising a graphite powder or a metal powder.

24. The bipolar electrolyzer of claim 21 wherein said bipolar electrode is electrically connected by resistance welding, tungsten inert gas welding, electron beam welding, diffusion welding, and laser welding.

25. The bipolar electrolyzer of claim 21 wherein said bipolar electrode is electrically connected by welding through an intermediate layer of a metal selected from the group consisting of vanadium, copper, silver, and gold.

26. The bipolar filter press electrolyzer of claim 25 wherein said intermediate layer is vanadium.

27. The bipolar electrolyzer of claim 25 wherein said anode is catalytically coated and comprises a discontinuous coating of a platinum group metal on a valve metal substrate and said cathode comprises a stainless steel.

28. The bipolar filter press electrolyzer of claim 27 wherein said valve metal substrate is selected from the group consisting of titanium niobium, and zirconium, said platinum group metal is platinum, and said stainless steel comprises about 20 to about 30 weight percent nickel, about 15 to about 25 weight percent chromium, and about 5 to about 7 weight percent molybdenum.

29. A filter press electrolyzer comprising multiple cell frame units each unit comprising a cell separator, an anode and a cathode wherein contact of said cell separator with said electrode is prevented by means of multiple filaments or strings of a non-conductive material wound around said anode or cathode.

30. The filter press electrolyzer of claim 29 wherein said non-conductive material is selected from the group consisting of polyesters, styrene copolymers, fluoropolymers, polychloroprene, and ethylene propylene diene monomer polymers.

* * * * *